United States Patent [19]

Kelley

[11] 3,966,422

[45] June 29, 1976

[54] POWDER METALLURGICALLY PRODUCED ALLOY SHEET

[75] Inventor: Eugene W. Kelley, Kokomo, Ind.

[73] Assignee: Cabot Corporation, Kokomo, Ind.

[22] Filed: May 17, 1974

[21] Appl. No.: 470,746

[52] U.S. Cl. ..... 29/182.7; 75/203; 75/213; 75/171

[51] Int. Cl.[2] ..... B22F 3/00; B22F 8/00; B22F 1/00

[58] Field of Search ..... 75/171, 203, 213; 29/182.7

[56] References Cited

UNITED STATES PATENTS

| | | | |
|---|---|---|---|
| 3,425,827 | 2/1969 | Lank | 75/171 |
| 3,433,631 | 3/1969 | Frank et al. | 75/171 |
| 3,649,256 | 3/1972 | Fletcher | 75/171 |
| 3,698,962 | 10/1972 | Kasak et al. | 148/11.5 F |

*Primary Examiner*—Benjamin R. Padgett
*Assistant Examiner*—Josephine Lloyd
*Attorney, Agent, or Firm*—Buell, Blenko, and Ziesenheim

[57] ABSTRACT

A sheet of cobalt-base alloy produced by hot working to gauge a slab of hot consolidated atomized prealloyed powder comprises a dispersion of carbide particles in a solid solution matrix, the particles having an average size less than those of the same alloy produced by casting an ingot and hot working it to gauge.

10 Claims, 3 Drawing Figures

POWDER METALLURGICALLY PRODUCED ALLOY SHEET

Figure 1:
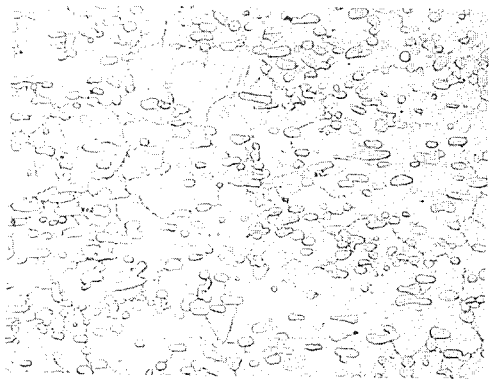

This invention relates to a new article of manufacture consisting of powder metallurgically produced alloy sheet. It is more particularly concerned with such a sheet having a metallurgical structure heretofore unobtainable, and markedly improved physical properties resulting therefrom.

Certain cobalt-base alloys comprising dispersions of fine carbides in solid solution matrix are industrially useful in articles having a cutting edge. Although those alloys have a hardness somewhat less than hardened steel, their service life greatly exceeds that of steel cutting edges, particularly in corrosive or oxidizing environments. A typical alloy of this type has the following composition, in percent by weight:

| Element | Nominal | Preferred Range | Broad Range |
|---|---|---|---|
| Chromium | 30 | 28 to 32 | 27 to 32 |
| Tungsten | 4.5 | 3.5 to 5.5 | 3.5 to 5.5 |
| Carbon | 1.65 | 1.4 to 1.9 | .9 to 2.4 |
| Molybdenum | 1.5 max | 1.5 max | 1.5 max |
| Boron | 1.0 max | 1.0 max | 1.0 max |
| Nickel | 3.0 max | 3.0 max | 3.0 max |
| Silicon | 2.0 max | 2.0 max | 2.0 max |
| Iron | 3.0 max | 3.0 max | 3.0 max |
| Manganese | 2.0 max | 2.0 max | 2.0 max |
| Cobalt | Balance | Balance | Balance |

The dispersed carbides are complex carbides, principally of chromium, tungsten and molybdenum. Although this alloy can be cast, and worked with difficulty, it has heretofore been very difficult to produce it in wrought forms in economical quantities. This is because the cutting quality of the finished wrought product, as well as its hot working properties, are found to deteriorate with increase in size of the dispersed carbide particles. As those carbides grow or coarsen considerably during the solidifying and cooling of the ingot, the size of such ingots is greatly restricted.

In all but the smallest ingots the carbides grow or coarsen considerably beyond the size corresponding to optimum cutting and working properties during the solidifying and cooling of the ingots. Many of the articles for which this alloy is suitable require it in the form of sheet, up to a width of 36 inches. This, of course, is the most troublesome form to produce because the extensive hot working to gauge provides opportunities for further carbide particle growth. A shop with which I am familar casts this alloy for sheet manufacture in ingots of nominally 13 pounds weight, measuring 8 inches × 6 inches × 1 inch, and works them under carefully controlled conditions. They are hand-rolled individually, the reduction per pass being about .02 inch. The material must be reheated after every second pass. The average size of the carbides in sheet about .070 inch thick, which is a commercially required gauge, produced as above outlined, is about 10 microns. The carbide size is not very sensitive to gauge as long as the time at temperature of the material during hot rolling and the necessary reheating and annealing is not unduly extended. It is evident that an ingot weighing no more than 13 pounds cannot provide a very considerable length of wide sheet of .070 inch gauge or thereabouts.

It is the principal object of my invention to provide in economical quantities sheet of the alloy above identified having dispersed carbides of an average size not greater than 10 microns or so. Other objects will appear in the course of the description thereof which follows.

The art of powder metallurgy comprehends the production of finished articles, often of complex shapes, by the consolidation of alloys in the form of powder. Relatively small, compact articles have generally been produced in this way, some in considerable quantities. The temperatures to which the articles are raised during consolidation can be kept well below the melting points of the alloys. Great uniformity of composition can be obtained if prealloyed powder, so-called, is used. That alloy powder is made by atomizing a melt of the desired composition with a gas and immediately quenching the particles. All the particles so formed are of the same composition. Although the alloy must, of course, be raised to melting temperature, the atomized particles are so small that they solidify almost instantly and therefore the dispersed carbides remain small in size.

My new article of manufacture comprehends an alloy sheet of the composition mentioned made by consolidating a slab of atomized prealloyed particles having a very finely dispersed carbide phase, that slab being much larger than the nominal 13 pound ingot heretofore employed, and hot working that slab to sheet, as by rolling. Both the consolidating and hot working steps are carried out so as to minimize carbide growth, as will be described. I am able in this way to provide sheet having a dispersed carbide phase several times smaller than that found in sheets produced by conventional practice, and knife blades made from the sheets of my invention are found to have cutting edges markedly superior to those previously available.

It is well-known to consolidate an alloy in powder form by the application of heat and pressure in various ways and to hot-work the compacted body. Alloy powder in lots of a few pounds has been consolidated for further working by various techniques, including hot extrusion, hot pressing, forging, and fluid isostatic pressure. The normal practice is to fill a metal container of the desired dimensions with the alloy powder, heat it to working temperature and consolidate it. For a small body, the force required can be generated without difficulty but when the weight of the billet or slab is measured, not in pounds, but in tens or hundreds of pounds, the force required dictates equipment of very considerable size. The difficulty is compounded when alloys of the type here concerned are consolidated because the working temperature must be kept below that at which the dispersed carbides grow significantly in size. I have found that this carbide growth in the alloy previously mentioned becomes excessive at temperatures above 2300°F.

Experiments which I have conducted show that powder in a 2½ inch diameter can be heated to 2300°F and squeezed for 2 minutes against a solid block in an extrusion press requires pressures of 22,000 pounds per square inch or more to consolidate the powder into a workable billet. Alloy powder in a can 3 inches × 8 inches × 8 inches, heated to 2275°F and pressed at 37,000 pounds per square inch in a die consisting of a square cutout in a 2 inch square plate provided billets which could be hot rolled, but cracked extensively during that rolling.

Vacuum hot pressing proved to be more successful. Fifteen pounds of alloy powder were charged into a die cavity ½ inch deep × 5 inches × 42 inches. The die was enclosed in a container with vacuum connections, heated to 2175°F, and compressively loaded at 1250 pounds per square inch for 3 hours while being continuously pumped. The resultant article, which was ¼ inch thick, had a density of about 98% of the theoretical density and rolled to sheet .03 inch thick without difficulty. The dispersed carbides in the sheet were, surprisingly, much smaller than those in articles produced by the prior art casting and working process. However, this process would require costly facilities.

If the area of the billet were to be increased, the pressing capacity would have to be increased correspondingly. If the thickness of the billet were to be increased substantially, the problem of containing the powder along the edges of the container during consolidating would be troublesome, and the heating of the contained powder would be tedious. The vacuum hot pressing operation is time-consuming, not only in heating and pressing time but in setting up and taking down the vacuum-connected container and disposing it in the press. The cycle time would be on the order of a day, and special equipment would be required to produce the material in quantity.

Hot isostatic pressing has been used to consolidate metal powder. It is carried out by subjecting the powder in a hot chamber to a fluid under pressure. The hot isostat or autoclave is an expensive piece of equipment, particularly so when built to accommodate large objects and to apply high pressures. I have found that alloy powder of the type here concerned can be consolidated by hot isostatic pressing to a density of 95% or better of the theoretical density at temperatures appreciably less than the critical temperature for carbide coarsening and at pressures of about 15,000 psi. I have also found that, by hot isostatic pressing, alloy powder masses of relatively large cross section can be consolidated to workable billets or slabs with improved characteristics.

Specifically, I consolidated a body of confined −30 mesh atomized prealloyed powder of the composition I have mentioned into a billet 2 inches by 3½ inches by 12 inches by hot isostatic pressing. I then found that in a larger isostat I could consolidate a body of confined alloy powder of the same composition into a slab measuring 4¾ inches by 15⅜ inches by 21⅞ inches under the same conditions of temperature, pressure and time as applied to the small billet. Likewise, I found that a large chamber isostat can be charged with a number of cans of powder of the slab size above indicated and all of them consolidated to the desired density in the same time and under the same pressure and temperature as a single can. The first step toward the production of my article, therefore, comprises consolidating a mass of alloy powder in this way.

As I have mentioned, the object of my invention is to provide sheets of the dispersed carbide alloy, which sheets may have widths up to about 36 inches. While the length as well as other dimensions of the sheets would be governed by the customer's requirements, economical production requires that the sheet should be produced in long lengths and sheared to size. The starting mass of consolidated powder must, therefore, be of substantial size, as has also been indicated. The terminology which most conveniently characterizes the metal in the course of its processing to be described, and which will be employed hereinafter, is that utilized by the iron and steel industry, and also employed where appropriate, in the nonferrous field. The mass of consolidated powder destined for sheet which takes the place of the ingot formerly employed corresponds rather well with steel industry slabs, which are defined as bodies of rectangular section at least 1½ inches thick with a cross-sectional area of 16 square inches or more.

The first step in the preferred process of producing my article comprises the consolidation of alloy powder by hot isostatic pressing into slabs. I make the slab as large as is economical for the desired sheets, subject to the limitations of the isostat chamber and handling facilities. The alloy powder screened to −30 mesh is charged into a container, preferably made of mild steel sheet ⅛ inch thick. This container is welded closed and is provided with connections to a vacuum pump for outgassing the powder. The container connected to the pump is then heated in a furnace to a temperature of about 1400°F and is pumped down until the pressure therein has been reduced to a low value, under 20 microns and preferably less than 3 microns. The container is then allowed to cool to room temperature, or a temperature above room temperature where sealing is to take place, while the pumping continues to maintain the pressure therein at the low value above mentioned. When the can is ready for sealing, the connections to the pump are sealed off and the container is disconnected therefrom. The above procedure must be followed if cracking and fracture of the alloy during subsequent hot working is to be avoided.

The outgassed powder is consolidated by loading the container into the chamber of an isostat where it is heated to a temperature of about 2100°F under fluid pressure of about 15,000 psi, held at that temperature and pressure for about two hours, and then allowed to cool to room temperature. During the cooling period, the pressure is allowed to fall to about 5,000 psi. This operation reduces the can's dimensions and consolidates the contained powder to a density of about 95% of theoretical density. A container of powder measuring 5¼ inches × 17 inches × 24 inches is consolidated to a slab measuring about 4¾ inches × 15⅜ inches × 21⅞ inches.

The slab provided as above described is then charged into a heating furnace without removing the container and heated to hot-working temperature of about 2150°F. It is allowed to soak at that temperature for 4 hours and is then hot-rolled in a suitable mill to an intermediate density closer to theoretical density and to an intermediate size article corresponding to the steel industry sheet bar. In a steel mill, sheet bar derived from an ingot is rolled in one direction only to long lengths and sheared into lengths corresponding to the width of the desired sheet. The thickness and width of the sheet bar is selected to provide sheets of the required gauge and length. Sheet bar thickness ranges from about ¼ inch to 1 inch. To produce my article, because of isostat limitations, no slab dimension may be as great as the width of the sheet desired, and it may be necessary to roll the slab lengthwise to bring it to the required sheet bar dimensions.

I find that to insure successful rolling the initial draft should be kept low, on the order of about 1% or .05 inch per pass. The work is reheated after about 4 passes. The draft is increased in steps to about .20 inch per pass when the work thickness is about half of the slab thickness, that is, about 6% to 8%, and then reduced in steps to about .05 inch per pass when the work thickness is about .50 inch, or about 10%. Sheet bar for sheet of around .06 inch thickness is preferably rolled to a thickness of about .375 inch.

During the preceding operation which brings the density of the bar approximately to the theoretical density of the alloy, it is protected from oxidation by the steel container, the thickness of which is correspondingly reduced. Much of it scales off. All the remaining steel of the container is trimmed off the sheet bar and it is further conditioned, if required, annealed in a furnace, and rolled in a sheet mill at a temperature of about 2150°F to a thickness of about .10 inch. If thinner sheet is required, the sheets of that thickness are doubled, that is, put through the mill in pairs, and so reduced to light guage.

The carbide particles in the resulting sheet are, surprisingly, much smaller than those in sheet made from ingots by the process of the prior art. The difference is observable in the attached figures which are all photomicrographs of sheet .07 inch thick of the alloy here concerned taken at a magnification of 500 diameters.

Figure 2:
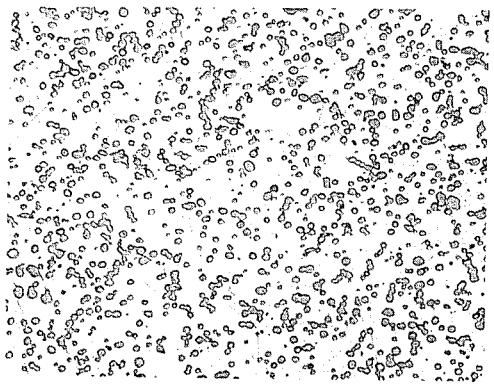
Figure 3:
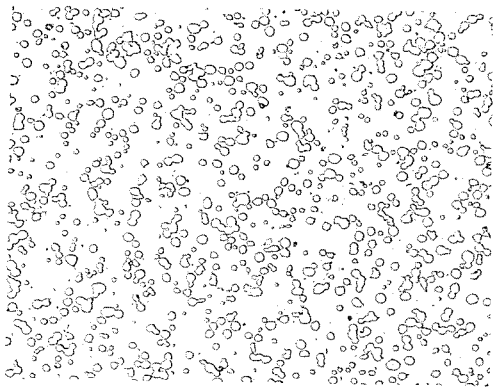

FIG. 1 is the sheet produced from a nominal 13 pound ingot in accordance with the prior art. The dark islands are carbides, which have an average size of about 10 microns, FIG. 2 is sheet produced by vacuum hot pressing 15 pounds of the powder into a quarter-inch thick flat bar as described herein, and rolling it to gauge. The carbides have an average size of 2 microns or somewhat less, FIG. 3 is sheet produced by hot isostatically consolidating about 400 pounds of the powder into a slab 4¾ inches by 15⅝ inches by 21⅞ inches in the manner here described, and hot rolling it to gauge, also in the manner described. The carbides have an average size of 2 microns.

My article may also be made, if desired, by consolidating the alloy powder in cans of circular cross section to a body of circular rather than rectangular cross section and working this body to sheet bar by forging or rolling or a combination of those processes. The sheet bar is then rolled to sheet in the way previously described.

Not only does my article comprise carbides of an average size much smaller than those found in sheet made from a cast ingot, but my article can be produced in the form of continuous sheet much longer than that previously available. As I have mentioned I have hot consolidated slabs weighing as much as 400 pounds from atomized prealloyed powder, many times the weight of the normal 13 pound ingots which were the largest that would be tolerated in the production of sheet from cast ingots. The size of those slabs and, therefore, the quantity of sheet of my invention derived therefrom is limited only by the size of the hot isostat or other apparatus used for consolidating the powder. I use the term "many times" in comparing the consolidated slab from which my sheet is worked with the cast ingots utilized in the prior art to indicate that the ratio is between magnitudes of wholly different orders.

In the foregoing specification I have described presently preferred embodiments of my invention; however, it will be understood that my invention can be otherwise embodied within the scope of the following claims.

I claim:

1. A new article of manufacture comprising an alloy sheet suitable for cutting edges produced by hot working to gauge a slab of hot consolidated atomized prealloyed powder, the powder consisting of about 27% to about 32% chromium, about 3.5% to about 5.5% tungsten, about 0.19% to about 2.4% carbon, up to about 1.5% molybdenum, up to about 2% manganese, up to about 3% iron, up to about 2% silicon, up to about 3% nickel, up to about 1% boron, and the balance cobalt, the consolidation and hot working being carried out at temperatures less than about 2300°F, the microstructure of the sheet comprising a dispersion of carbide particles in a solid solution matrix, the carbide particles having an average size less than 10 microns.

2. The article of claim 1 containing about 28% to 32% chromium and about 1.4% to 1.9% carbon.

3. The article of claim 1 in which the carbide particles have an average size of about 2 microns.

4. The article of claim 1 in which the prealloyed powder is minus 30 mesh.

5. The article of claim 1 in which the weight of the slab is many times 13 pounds.

6. The article of claim 1 in which the slab is consolidated to 95% or better of theoretical density by hot isostatic pressing at a fluid pressure of at least 15,000 psi at a temperature of at least about 2100°F for a time of at least about 2 hours.

7. The article of claim 6 in which the slab before consolidating is outgassed by heating it to a temperature of at least 1400°F while exhausting gases therefrom.

8. The article of claim 7 in which the gases are exhausted to a pressure less than about 3 microns.

9. The article of claim 8 in which the pressure is maintained at less than about 3 microns while the outgassed powder cools to a temperature at which the canned powder is sealed for consolidation.

10. The article of claim 1 in which the slab is worked to sheet bar less than a half inch thick by hot rolling, the draft per pass increasing from about 1% at the start of rolling to between about 6% and about 8% when the slab thickness is reduced about 50%, and to about 10% at a sheet bar thickness of about one half inch.

* * * * *